US007285523B1

(12) United States Patent
Seydel et al.

(10) Patent No.: US 7,285,523 B1
(45) Date of Patent: Oct. 23, 2007

(54) ENZYME-CONTAINING GRANULE AND DETERGENT COMPOSITION

(75) Inventors: Scott O. Seydel, Atlanta, GA (US); Robert Keith Salsman, Hoschton, GA (US)

(73) Assignee: Seydel Companies, Inc., Pendergrass, GA (US)

( * ) Notice: Subject to any disclaimer, the term of this patent is extended or adjusted under 35 U.S.C. 154(b) by 1484 days.

(21) Appl. No.: 09/549,647

(22) Filed: Apr. 14, 2000

Related U.S. Application Data

(63) Continuation of application No. 09/233,254, filed on Jan. 19, 1999, now abandoned.

(51) Int. Cl.
*C11D 3/37* (2006.01)
*C11D 3/386* (2006.01)

(52) U.S. Cl. ..... 510/441; 510/476

(58) Field of Classification Search ..... 510/114, 510/392, 441, 476
See application file for complete search history.

(56) References Cited

U.S. PATENT DOCUMENTS 4,977,191 A * 12/1990 Salsman ..... 521/48
5,434,069 A * 7/1995 Tsaur et al. ..... 435/188
5,589,370 A * 12/1996 Ratuiste et al. ..... 264/4.3
5,656,584 A * 8/1997 Angell et al. ..... 510/441

FOREIGN PATENT DOCUMENTS

WO WO 93/21294 * 10/1993
WO WO 97/19161 * 5/1997

* cited by examiner

*Primary Examiner*—John R. Hardee
(74) *Attorney, Agent, or Firm*—McNair Law Firm, P.A.; William D. Lee, Jr.

(57) ABSTRACT

The instant invention discloses an enzyme-containing granule comprising: (a) a core granule comprising one or more enzyme particles; and (b) a water-soluble polymer coating therefor which substantially completely encapsulates said enzyme particles, wherein the polymer coating comprises a water-soluble or water-dispersible polyester resin, which comprises a reaction product of 20%-50% by weight of waste terephthalate polymer, 10-40% by weight of at least one glycol and 5-25% by weight of at least one oxyalkylated polyol.

18 Claims, No Drawings

ENZYME-CONTAINING GRANULE AND DETERGENT COMPOSITION

This is a continuation of U.S. patent application Ser. No. 09/233,254, filed Jan. 19, 1999, now abandoned.

FIELD OF INVENTION

This invention relates to an enzyme-containing granule comprising a core of a cleaning enzyme and a water-soluble or water-dispersible polyester resin coating, a process of producing such granule, and a detergent composition containing such granule.

BACKGROUND OF INVENTION

There are many detergent active materials which require protection from atmospheric moisture, air and co-ingredients of compositions with which they are formulated. The major kind of such actives are enzymes, especially of microbial origin. It is also well known in the detergent industry that the use of enzymes, particularly proteolytic enzymes, has created industrial hygiene concerns for detergent factory workers, particularly due to the health risks associated with dustiness of the available enzymes.

Enzymes have the ability to degrade and promote removal of certain soils and stains by the cleavage of high molecular weight soil residues into low molecular weight monomeric or oligomeric compositions readily soluble in cleaning media, or to convert the substrate into different products, therefore, they are highly efficient laundry washing ingredients used to promote removal of soils and stains during both industrial and household cleaning processes. Exemplary of such enzymes are those selected from the group of enzymes which can hydrolyze stains and which have been categorized as hydrolases, including amylases, proteases, lipases, and cellulases.

When formulating dried particulate products such as would be made in a fluid bed dryer (e.g. particles for use in washing compositions), two problems normally occur. The first problem is that of dusting. The method of manufacturing particles can create very fine powders which cause dermatologic effects when the product contains sensitizing agents (e.g. enzymes in a detergent granule). The second problem relates to the need to incorporate relatively high amounts of ingredients such as enzyme protecting agents, masking agents and scavengers (e.g. chlorine scavengers) into products for the purpose of binding ions which can inactivate an active ingredient in the particle. It would be desirable to use less of these types of materials or to use them without interfering with enzymes that may be present.

Many commercially useful enzymes are produced by microorganisms, particularly bacteria, yeast and filamentous fungi. These enzymes are especially useful in detergent and food applications. With the advent of biotechnology and recombinant DNA techniques, other enzymes from mammlian sources are produced recombinantly in microorganisms. When enzymes are produced in a microbial host they are usually either secreted directly into the fermentation both by the microorganism or released into the fermentation broth by lysing the cell. The enzyme can then be recovered from the broth in a soluble form by a number of techniques including filtration, centrifugation, membrane filtration, chromatography and the like. The dissolved enzyme can be converted to a dry form from a liquid using techniques such a precipitation, crystallization or spray-drying. A problem associated with dry enzyme preparations is that there is a high dust level associated with them, which can cause dermatologic distress to the manufacturer, consumer or any other person handling the enzyme. It has been a desire in the art to treat these dry enzymes so as to reduce the hazard of dusting. To control dusting and increase particle size, dry enzymes are often granulated by various means known by those skilled in the art.

Various enzyme formulations and processes for these preparations have been developed in an effort to alleviate the dusting problem. For example, German Patent No. 21 37 042 discloses a process in which an enzyme-containing formulation is extruded through a die onto the revolving plate of a spheronizing device to form sperical particles of the enzyme-containing formulations which are optionally coated with a material designed to prevent dusting.

In U.S. Pat. No. 4,087,368, there is disclosed an enzyme granule formulation in which rods or spheres of an enzyme in admixture with magnesium alkyl sulfate and ethylene oxide are provided.

U.S. Pat. No. 4,016,040 discloses a method for the preparation of free-flowing substantially dust-free, spherical enzyme-containing beads prepared by blending a powdered concentrate of the enzyme with a binder in molten form and spraying droplets of the blend through a spray nozzle into cool air to solidify the droplets and form the beads.

U.S. Pat. No. 4,242,219, features a process for the preparation of enzyme-containing particles prepared by mixing the dry enzyme with a hydrophilic organic cohesive material, a building agent or a mixture regulating agent and mechanically dividing it into particles of the desired size and shape which are then coated with a water repellent material.

Another type of granular enzyme formulation is disclosed in U.S. Pat. No. 4,009,076. This formulation is prepared by mixing the dry enzyme with a solid nonviable substance and optionally a cohesive organic material as binder to form an enzymatically active core. An enzyme slurry containing the cohesive organic material can be sprayed onto, for example, sodium tripolyphosphate in a mixer or an enzyme powder can be mixed with the sodium tripolyphosphate and the cohesive organic material sprayed onto it with subsequent extrusion through a die. The enzyme-containing granule is sprayed with an aqueous solution containing a plasticized organic resin, then dried.

A process is described in GDR Patent 0 151 598 in which sodium tripolyphosphate is sprayed with an aqueous fermentation broth and agglomerated in a cyclone apparatus. The agglomerates are removed from the cyclone apparatus while still wet and placed in a mechanical blender with a drying detergent formulation and intensively mixed.

British Patent No. 1,483,591, teaches a process for coating water soluble or water dispersible particles, including enzyme particles, using a fluidized-bed reactor. This reference involves a dust-free coating technique for enzyme particles which have been granulated by other processes such as prilling or spheronizing.

In U.S. Pat. No. 4,689,297, there is disclosed a method for preparing dust-free enzyme involving dissolving or suspending dry enzyme in solution to make a slurry of at least 30% w/w of the solids enzymes, spraying it on a hydratable core and then coating it with macromolecular material.

PCT patent application 87/00057 relates to a detergent enzyme product with an enzyme core on which is an enteric coating. Such coatings are water soluble and dissolve readily at high pH's while resisting dissolution at low pH's.

Oxidant scavengers or enzyme protecting agents or masking agents can be included in washing compositions to bind free ions, compounds or the like, which may inactivate the enzyme or decrease its efficacy or otherwise interfere with the ability of the detergent or enzyme preparation.

It is desirable to produce improved dust free particles which can decrease or eliminate the need for scavengers, enzyme protecting agents, or masking agents and other such compounds or increase the effectiveness of enzymes in the presence of ions. Also, it is well known in the art that enzymes are very sensitive proteins which have a tendency to denature in harsh environments, thus enzyme deactivation may occur. It is therefore often desirable to protect a sensitive enzyme component during storage yet ensure its release in a controlled and reproducible manner.

Various methods to stabilize enzymes and provide a good mixture of enzyme and detergent have also been proposed.

U.S. Pat. No. 5,225,102 to Coyne et al. discloses a hydrolase enzyme-containing composition and method of stabilizing said enzyme by coating or encapsulating the enzyme with a water soluble polymer, which is selected from the group consisting of polyethylene glycol, polyvinyl alcohol, polyvinyl pyrrolidone, and poly (methyl vinyl ether/maleic acid).

U.S. Pat. No. 5,324,649 to Arnold et al. describes a granular enzyme composition which comprises a core, an enzyme layer and outer coating layer. The enzyme layer contains a vinyl polymer, preferably, a hydrolyzed polyvinyl alcohol or copolymer thereof.

U.S. Pat. No. 5,434,069 to Tsaur et al. teaches a capsule for protecting sensitive ingredients such as enzymes. The capsule, in addition to a protected sensitive ingredient, comprises an oil dispersion containing the active and a polymer shell surrounding the oil dispersion, wherein said polymer shell is a water soluble or water dispersible polymers selected from polyvinyl alcohol, a polyacrylamide, polyvinyl pyrrolidone, etc.

U.S. Pat. No. 4,973,417 to Falholt provides a granular detergent enzyme product comprising a core of a microbial enzyme containing material with an enteric coating. Due to this coating the enzymatic stability is significantly improved in the presence of other detergent components such as strong bleaching agents. The coating comprises a copolymer of (meth)acrylic acid and a (meth)acrylic acid derivative.

U.S. Pat. No. 4,898,781 to Onouchi et al features the use of hydrophilic substance comprising an enzyme and a water-containing polyhydroxy compound as a core, which is coated with a coating material of polyvinyl alcohol.

Accordingly, there is a need in the art for some kind of enzyme granule coating materials which can more effectively protect the active enzymes from bleaches or other harsh components found in the detergent composition.

Further, there is a need to find such coating materials which also readily and efficiently release the active enzymes in use and do not have negative effect on enzymatic activity when using this coated enzyme granule.

OBJECTS OF THE INVENTION

It is an object of the present invention to provide an enzyme-containing granule that can stabilize and isolate sensitive enzymes in the detergent composition while simultaneously being able to release the active enzymes in a controlled and reproducible manner when the granule is utilized as a detergent ingredient.

It is another object of the present invention to provide a process for producing encapsulated enzyme-containing granule.

A further object of this invention is to provide a detergent composition comprising said enzyme-containing granule.

Surprisingly, it has been found that these objectives can be achieved by the use of at least one water-soluble or water-dispersible polyester resin disclosed in U.S. Pat. No. 4,977,191 as an enzyme coating materials, which can provide an enzyme granule having improved characteristics such as increased stability, low residue (upon dissolution), delayed enzyme release and low dust. It has also been found that such improved granules can be produced in a much reduced cost and processing time.

SUMMARY OF THE INVENTION

The present invention relates to an enzyme-containing granule comprising: (a) a core granule comprising one or more enzyme particles; and (b) a water-soluble polymer coating therefor which substantially completely encapsulates said enzyme particles, said polymer coating comprising a water-soluble or water-dispersible polyester resin, which comprises a reaction product of 20%-50% by weight of waste terephthalate polymer, 10-40% by weight of at least one glycol and 5-25% by weight of at least one oxyalkylated polyol.

The instant invention is also directed to a detergent composition, comprising: (a) 0.1-20% by weight, based on the composition, of the enzyme-containing granule containing the polyester coating described above; (b) 0.1-60% by weight, based on the composition, of a detergent builder; (c) 0-20% by weight, bases on the composition, of a surfactant selected from the group consisting of anionic, nonionic, cationic, ampholytic and zwitterionic surfactants or mixtures thereof; and (d) optionally, water.

It also has been found that a dry dust-free particle can be produced which reduces the need for scavengers, protecting agents, or masking agents and/or improves the effectiveness of enzymes therein and additionally provides a particle with delayed dissolution times. The product comprises a particulate material to which has been applied a continuous layer of a water dispersible polyester polymer described above or other warp size agent, preferably in the presence of a detergent. Particularly within the scope of this invention are enzyme and detergent particles prepared with a water soluble or water dispersible polyester polymer as described above.

The present invention is also directed to method for the production of dust free enzyme containing particles. The method comprises the steps of: (a) introducing a particulate, hydratable core material such as a clay particle or a sucrose crystal into a fluid bed dryer and maintaining the core particles suspended in the dryer's reaction chamber; (b) providing an aqueous slurry of a water soluble or dispersible enzyme and applying the enzyme to the surface of the core particles by spraying the slurry onto them while they are suspended in the reaction chamber to leave residual, dried enzyme coated on the core particles in an amount sufficient to provide the desired enzyme activity; (c) spraying a solution or dispersion of a polyester, film-forming, water soluble or water dispersible coating agent onto the enzyme coated core material while it is still suspended in the reaction chamber and drying the solvent to leave a continuous layer of the film-forming material on the enzyme coated core particle to provide the desired dust free enzyme containing particle. Also included within the scope of this invention are the enzyme containing particles prepared by this process.

DETAILED DESCRIPTION OF THE INVENTION

In the first aspect, the present invention provides an enzyme-containing granule comprising (a) a granule core comprising one or more enzyme particles; and (b) a water-soluble polymer coating therefor which substantially completely encapsulates said enzyme particles, said coating polymer comprising a water-soluble or water-dispersible polyester resin, which comprises a reaction product of 20%-50% by weight of waste terephthalate polymer, 10-40% by weight of at least one glycol and 5-25% by weight of at least one oxyalkylated polyol.

The second aspect of this invention includes a process for producing encapsulated enzyme-containing granule comprising selecting a core material to be encapsulated, optionally agglomerating the selected core material, mobilizing the particles and coating the mobilizing particles with a water-soluble or water-dispersible polymer therefor which substantially completely encapsulates said enzyme particles, said coating polymer comprises a water-soluble or water-dispersible polyester resin, which comprises a reaction product of 20%-50% by weight of waste terephthalate polymer, 10-40% by weight of at least one glycol and 5-25% by weight of at least one oxyalkylated polyol.

A third aspect of the invention comprises a detergent compositions which comprises (a) 0.01-20% by weight of an enzyme-containing granule including a core comprising one or more enzymes; (b) 0.1-60% by weight of a detergent builder; (c) 0-20% by weight of a surfactant; and (d) optionally, water.

The coating polymers, core enzymes, coating process and detergent composition are described respectively below.

Coating Polymers

The enzyme granule coating polymers useful in the present invention are water-soluble or water-dispersible polyester resins which are made from waste terephthalate polymers, including bottles, sheet material, textile wastes and the like. The waste terephthalate plastics may be bought from recyclers and include, but are not limited to, material identified as "PET rock." The waste terephthalate can be characterized by the unit formula

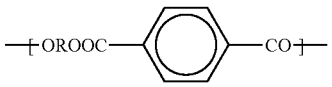

wherein R is the residue of an aliphatic or cycloaliphatic glycol of 2-10 carbons or of an oxygenated glycol of the formula $$HO(C_xH_{2x}O)_nC_xH_{2x}OH$$

wherein x is an integer from 2-4 and n is 1-10.

Preferably the waste terephthalate polymer is polyethylene terephthalate, polybutylene terephthalate, poly(cyclohexanedimethanol terephthalate) or a mixture thereof.

It will be understood that, for reasons of economy, the use of waste terephthalates is preferred. However, the use of virgin terephthalate resins is to be included within the scope of the disclosure and appended claims.

The glycol with which the waste terephthalate polymer is reacted can be selected from among a variety of known dihydric alcohols. Preferred glycols include, but are not limited to, ethylene glycol, diethylene glycol, triethylene glycol, cyclohexanedimethanol, propylene glycol, butylene glycol, neopentyl glycol, 1,5-pentanediol, 1,6-hexanediol or mixtures thereof. Most preferably, the glycol is a mixture of diethylene glycol and neopentyl glycol.

The oxyalkylated polyol is derived from any polyol, having three or more alcohol functions. Polyols include glycerol, trimethylolpropane, trimethylolethane, pentaerythritol, erythritol, sorbitol, mannitol, other sugar alcohols or monosaccharides. The polyols are oxyalkylated with an alkylene oxide, including, but not limited, to ethylene oxide, propylene oxide, butylene oxide, amylene oxide, etc.

Preferably, the oxyalkylated polyol is glycerol, trimethylolpropane, trimethylolethane, pentaerythritol, erythritol or a monosaccharide, oxyalkylated with 5-30 moles of ethylene oxide, propylene oxide or a mixture thereof, per hydroxyl of the polyol.

The water-soluble or water-dispersible polyester resins can further include 3-15% by weight of trimellitic acid or anhydride as well as 1-10% by weight of polyol. Polyols are chosen as above.

The polyester resins can be made by heating waste terephthalate polymer, glycol, oxyalkylated polyol and, optionally, isophthalic acid together in any order until breakdown and reconstruction of a mixed terephthalate-isophthalate ester has occurred. This process normally requires, for acceptable reaction times, temperatures above about 150° C. to the decomposition point of the ester product.

In making the water-soluble or water-dispersible polyesters, it is preferred to heat the waste terephthalate polymer, glycol and oxyalkylated polyol above about 150° C. to partially breakdown the terephthalate and then to heat the thus-produced intermediate with isophthalic acid under similar temperature conditions.

A most preferred product is that obtained by heating waste terephthalate polymer, glycol and oxyalkylated polyol above about 150° C. to produce an intermediate product, characterized by a 15-minute clear peel, and heating the thus-obtained intermediate product with isophthalic acid at a temperature of at least 150° C.

Polyester resins, containing trimellitic acid or trimellitic anhydride, are preferably made by heating an isophthalic acid-containing intermediate with trimellitic acid or trimellitic anhydride. It is preferred to obtain an intermediate, having a 15-minute clear peel, before reaction with isophthalic acid and then with trimellitic acid or anhydride.

Resins made from waste terephthalate polymer, glycol and isophthalic acid are preferably made by heating waste terephthalate polymer with at least one glycol above about 150° C. to produce an intermediate product, characterized by a 15-minute clear peel, and heating the thus-obtained intermediate product with isophthalic acid at a temperature of at least 150° C. Subsequent reaction with trimellitic acid or trimellitic anhydride is preferred.

Preferred terephthalate feeds are as above. Most preferred feeds are polyethylene terephthalate or poly(cyclohexanedimethanol terephthalate).

Glycols are as recited above. Particularly preferred is a mixture of diethylene glycol and cyclohexanedimethanol.

A preferred product is that comprising a reaction product of 20-50% by weight of polyethylene terephthalate, 10-30% by weight of diethylene glycol, 20-50% by weight of isophthalic acid and 3-15% by weight of trimetllitic acid or trimellitic anhydride.

A highly-preferred water-soluble or water-dispersible polyester resin comprises a reaction product of 20-50% by weight of polyethylene terephthalate, 10-30% by weight of diethylene glycol, 1-10% by weight of pentaerythritol, 5-25% by weight of oxyalkylated glycerol of 5-30 oxyalkyl units per hydroxyl, 20-50% by weight of isophthalic acid and 3-15% by weight of trimellitic acid or trimellitic anhydride.

The polyester resins are usually and preferably made using an ester-interchange catalyst. These catalysts are well known organometallic compounds, particularly compounds of tin or titanium. Preferred catalysts include tetraalkyl titanates, in which the alkyl is of up to 8 carbon atoms, as well as alkyl stannoic acids or dialkyl tin oxides, such as monobutyl stannoic acid or dioctyl tin oxide. Preferred catalysts include monobutyl stannoic acid and tetrapropyl or tetrabutyl titanate, or a mixture thereof.

The resinous products obtained are generally taken up in relatively concentrated aqueous solutions of alkali metal or ammonium hydroxides or carbonates. The concentration employed can be determined by routine experimentation. However, if shipping of the concentrated aqueous solutions to a point of use is contemplated, it is preferred to produce highly concentrated solutions.

The thickness of the coating that is applied to the enzyme granule or prill will, to some degree, depend upon the procedure used to apply the coating. When enzyme prills were coated with the polyester solution (formulation 1 of Example 1) to a 15% weight gain, the coating averaged about 15 microns in thickness. When the same enzyme prills were coated with the same coating to a weight gain of 25%, the coating averaged approximately 19 microns in thickness. Generally, the coating will comprise about 3 to 500% or more by weight of the uncoated enzyme, preferably 5 to 100%, more preferably 10 to 40%, most preferably 15 to 30% by weight. It is obvious that increased coating thickness will decrease enzyme solubility for any given coating. It is therefore desirable to provide a coating which substantially completely coats or encapsulates the granule, which is uniform and durable, easy to apply, causes little or no agglomeration of the coated granules, and which yields adequate solubility in aqueous media, while suitably protecting the activity of the enzyme.

The coated enzyme granules must provide sufficient solubility in detergent solution that enzymes are readily released under wash conditions. A standard detergent solution may be made by dissolving 1.5 grams of Tide™ (Procter and Gamble) in one liter of water at 20° C. In general, 90% of the discrete enzyme-containing coated granules should dissolve, disperse or disintegrate in detergent solution at about 20° C. within about 15 min., preferably within about 12 min., and more preferably within about 8 min.

Core Enzymes

Any enzyme or combination of enzymes may be used in the present invention. Commonly utilized enzymes include those enzymes capable of hydrolyzing substrates, e.g. stains. Accepted nomenclature for these enzymes, under the International Union of Biochemistry, is hydrolase. Hydrolases include, but are not limited to, proteases (bacterial, fungal, acid, neutral or alkaline) which attack proteinaceous residues, amylases (alpha or beta, also known as carbohydrases) which digest carbohydrates such as starches, lipases (also known as esterases) which digest fats, cellulases which digest cellulosic polysaccharides, and mixtures thereof. Most preferred enzymes are amylases and cellulases.

The amylolytic enzymes for use in the present invention can be those derived from bacteria or fungi. Preferred amylase is Maxamyl derived from *Bacillus licheniformis* and available from Gist-Brocades of the Netherlands. Another useful amylase sold by Novo is Termamyl 300 1Dx. It is an alpha-amylase prepared by submerged fermentation of a selected strain of *Bacillus liceniformis*. These amylolytic enzymes are generally sold as granules and may have activities from about 2 to 10 Maltose units/μg. The amylolytic enzyme is normally included in an amount of from 1% to 50% by weight of the enzyme-containing granule, preferably from 5% to 30% by weight.

The proteolytic enzyme can be of vegetable, animal or microorganism origin. The preferred origin is microorganism, including yeasts, fungi, molds and bacteria. Particularly preferred are bacterial subtilisin type proteases which are obtained from particular strains of *B. subtilis* and *B. licheniformis*. Examples of suitable commercially available proteases are Alcalase, Esperase and Savinase, sold by Novo Industri A/S; Maxatase and Maxacal of Gist-Brocades NV; Kazusase of Showa Kenko; BPN and BPN' proteases and so on. These proteolytic enzymes are generally sold as granules and may have enzyme activities of from about 500 to 50,000 glycine units/μg. The proteolytic enzyme is normally included in an amount of from 1% to 50% by weight of the enzyme-containing granule, preferably from 5% to 30% by weight.

Suitable cellulase enzymes used in the present invention are those produced by the strains of *Bacillus pasteuri, Trichoderma viride*, and *Aspergillus niger*. Examples of these cellulases are Cellulase 123™ and Multifect™ L250, commercially available from Genencor International, or mixtures thereof. The cellulase enzyme is normally included in an amount of from 1% to 50% by weight of the enzyme-containing granule, preferably from 5% to 30% by weight.

The lipolytic enzyme for use in the present invention may be either a fungal lipase producible by e.g., *Humicola lanuginosa* and *Thermomyces lanuginosus*, or a bacterial lipase produced by the stains of e.g., *Chromobacter viscosum* and *Rhizopus delemer*. An example of a fungal lipase is the lipase ex *Humicola lanuginosa*, available from Amano under the tradename Amano CE. The lipolytic enzyme is normally included in an amount of from 1% to 50% by weight of the enzyme-containing granule, preferably from 5% to 30% by weight.

Naturally, mixtures of the above hydrolases can be used as an enzyme core in the present invention.

While various specific hydrolases have been described above, it is to be understood that any hydrolase which can render the desired enzymatic activity to the detergent composition may be used and this invention is not intended to be limited in any way by specific choice of hydrolytic enzyme.

In addition to hydrolases, it is to be understood that other enzymes such as oxidases, reductases, peroxidases, and the like which are well known in the art may also be utilized in the present invention.

Adjunct ingredients may be added to the enzyme granules of the present invention. Adjunct ingredients may include metallic salts, solubilizers, dyes, inhibitors, binders, fragrances, antioxidants, enzyme protecting agents/scavengers which chemically react to neutralize any oxidant with which it comes in contact, thereby enhance the stability of the coated enzyme during the storage thereof. Such protective agents include the alkali metal silicates and carbonates, most preferably sodium silicates and sodium carbonates. When the alkali metal silicates are used as protective agents, care must be taken to provide sufficient solubility. Such protective agents may also include reducing agents, i.e., sodium sulfite and sodium thiosulfite; antioxidants, i.e. BHA and BHT; and transition metals, i.e., iron, cobalt, nickel, and copper. These agents may be used in conjunction with carriers, especially with the water-soluble polyester resins.

The amount of active protective agents which are required to protect the enzyme will depend upon the nature of the oxidant (e.g., bleach), upon the temperature and relative humidity of the environment, and the expected length of time for storage, as well as the type of protective agent or combination thereof used.

The enzymes may be coated in any physical form. Enzyme prills, which are commonly provided commercially, provide a particularly convenient form for coating, as they may be fluidized and coated in a fluid-bed spray coater. Enzymes, in prill form or other forms, may be coated, for example, by mixing, spraying, dipping, or blotting. Other forms of coating may be appropriate for other enzyme forms, and will be readily apparent to those skilled in the art. Where necessary, a wetting agent or binder such as Neodol™ 25-12 or 45-7 may be used to prepare the enzyme surface for the coating material.

Coating Process

Coated enzyme granules are prepared by substantially completely coating or encapsulating the enzyme particles with a water-soluble or water-dispersible polyester resin as described above.

There are several method of effecting the coating or encapsulating of the invention, including a usual fluid bed process, a Wurster bed process or a rotor bed (Glatt) process. The fluid bed method can be carried out batch wise or continuously.

In the usual fluid bed operation utilizing a top spray, air is introduced into the bed from below while the aqueous solution of coating polymer is sprayed onto the fluidized enzyme particles to be coated from above. The enzyme particles move randomly in the bed.

In the Wurster process, the coating polymer is sprayed from the bottom of the bed concurrently with the air flow, while the enzyme particles to be coated move in a well-defined flow pattern as is known in the art.

It has been surprisingly discovered that use of the Wurster spray mode results in many benefits. For instance, the agglomeration in the Wurster mode is significantly lower than in the top spray mode. When operated under optimum conditions, upwards to 5-15% of the particles coated by top spray may agglomerate, whereas the level of agglomerated particles from the Wurster application of a fluidized bed rarely exceeds 2% of the particles. It is usually preferred to use a spray-on rate of from about 10 to 40 g/min/kg. for economic processing and good product quality, more preferably, from about 1 to 10 g/min/kg.

There are many commercially available fluid bed apparatuses which are suitable for use in the coating process of the present invention. Among these are the GPCG-5 and GPCG-60 models of Glatt Air Techniques of Ramsey, N.J. These two models can coat 8 to 225 kg loads of the particles in from 0.5 to 3 hours, respectively.

The method of producing the coated enzyme of the present invention can carried out in a fluid bed dryer. Typically, such devices comprise a dryer consisting of a circular product chamber that has a porous grid on the bottom and is open on the top to be put up against a conical shaped expansion chamber of a larger diameter than the circular product chamber. In operation, as the velocity of air passing up through the chamber is increased, a point is reached where particles resting on the porous grid are suspended in the air flow as a fluid, hence the terms "fluidization" and "fluid bed dryer". The particles are lifted by the upward force of the air out of the product chamber into the expansion chamber where the air expands and the upward force per unit of area is reduced. This allows the particles to fall back into the product chamber and start the cycle over.

The initial step in the method involves introducing a particulate, hydratable core material into the reaction chamber of the fluidized bed reactor and suspending the particles therein on a stream of air. The core particles are preferably of a highly hydratable material, i.e. a material which is readily dispersible or soluble in water. The core material should either disperse (fall apart by failure to maintain its integrity) or solubilize by going into a true solution. Clays (bentonite, kaolin), non-pareils and agglomerated potato starch are considered dispersible. Non-pareils are spherical particles consisting of a solid core that has been rounded into a spherical shape by binding layers of powder to the core in a rotating spherical container. The non-pareils used in the examples which follow have a sugar (typically sucrose) crystal core (−50 mesh on the U.S. Standard Sieve Series) that was rounded by binding layers of corn starch onto the core using sugar as a binder. The sugar used for binding was dissolved in water (50% w/w) and sprayed onto a mixture of sugar and corn starch while they were being rotated in a 66 inch Groen Stainless Steel Rotating Pan which were then heated to drive off the water. When the crystals had been rounded into approximately 20 mesh to 60 mesh spheres, they were dried and sieved whereupon the −20 mesh +60 mesh fractions were put back into the rotating pan and heated. They were then coated with a layer (approximately 10% w/w) of dextrin from an aqueous solution (50% w/w) that was sprayed onto the spheres while heating to drive off the water. The finished product was again sieved to −20 mesh +60 mesh. Salt particles (NaCl crystals, NaCl rock salt, $NaHCO_3$) are considered soluble. More particularly, core particles can be non-pareils of a salt crystal, starch and a sugar solution or a sugar crystal, starch and a sugar solution with or without a final coat of dextrin or a confectionery glaze. Also suitable are agglomerated trisodium citrate, pan crystallized NaCl flakes, bentonite granules and prills, bentonite/kaolin/diatomaceous earth disk pelletized granules and sodium citrate crystals. The core particle is of a material which is not dissolved during the subsequent spraying process and is of a particle size of from 150 to 2,000 microns (100 mesh to 10 mesh on the U.S. Standard Sieve Series) in its longest dimension.

Enzymes suitable for use in this method are those which are soluble or dispersible in an aqueous media and from which the water can be removed to leave a residual layer of enzyme on the surface of the core material. Suitable enzymes include, for example, proteases (bacterial, fungal, acid, neutral or alkaline), amylases (alpha and beta) and lipases whose water solutions or dispersions are prepared by dispersing or dissolving a precipitated enzyme cake in water using vigorous agitation. Typically, the enzyme precipitate is dissolved or dispersed at a level of 15% to 30% solids (w/w) of which 100% down to about 30% is enzyme with the remaining solids comprising metallic salts, binders, plasticizers and fragrances. The dispersion, including any optional binders, metallic salts, stabilizers or fragrances must have a viscosity low enough (typically 10 to 5,000 cps at room temperature) to be pumped and atomized for effective spray coating. The enzyme is applied to the surface of the core material by fluidizing the core particles in a flow of air whereupon a solution containing the enzyme and optionally other solids is then atomized and sprayed into the fluidized bed. The atomized droplets contact the surface of the core particles leaving a film of the solids adhering to the surface of the particles when the water is evaporated. When sufficient enzyme is applied to the core particles to provide the desired enzyme activity, the enzyme coated particles, while still suspended in the reaction chamber of the fluidized bed reactor, are coated with a uniform layer of a water soluble or water dispersible, polyester, film-forming coating agent. This is accomplished in a manner similar to that used for application of the enzyme coating. The net result of the process is to provide an enzyme coated core particle having a continuous layer of the film-forming material on its surface to provide the desired dust free enzyme containing particle.

The dust free enzyme particles of the present invention can be used wherever enzymes are needed in an aqueous system. Thus, they can be used as additives to detergent formulations, for removing gelatin coatings on photographic films to aid in silver recovery, in the digestion of wastes from food processing plants for nitrogen recovery, in denture cleansers for removing protein bound stains and as a processing aid in waste water treatment.

The method of practicing the invention is further illustrated by the examples illustrated below where all mesh sizes are on the U.S. Standard Sieve Series, and the dryer is a Uni-Glatt laboratory model fluid bed dryer with variable air temperature and flow through the bed. The device has a 6 inch Wurster insert which consists of a container (5½" diameter by 6½" height) for the core material that fits against the bottom of the device's expansion chamber. The plate on the bottom of the Wurster has holes in it to distribute the air through the bed with the holes in the center being of a larger diameter than the rest of the holes in the plate. A cylindrical hollow tube (2¾ inches diameter by 6 inches length) called a partition is suspended above these larger diameter holes creating a higher air flow up through the partition than up around the outside of the partition. The air flow is adjusted based on the quantity and density of the core particles so that the particles flow up inside the partition into the expansion chamber then fall back down outside the partition into the area with less air flow while the bed is kept fluidizing and drying. This difference in air flow creates a circular upward and downward movement of the particles. The spray nozzle is installed at the bottom of the partition pointed upwards. This arrangement keeps the atomized liquid co-current with the motion of the cores being coated and results in a smooth coating. The speed of the circular flowing motion of the cores is adjustable by regulating the amount of air going through the partition and the amount of air going around the outside of the partition. The droplet size of the atomized enzyme solution spray is adjusted by adjusting the liquid pumping rate and the air pressure for atomization. The process can be accelerated by using counter current downward spray without using the Wurster column. The height of the Wurster insert partition is adjustable vertically and was adjusted from ¼ inch to ¾ inch up from the bottom plate. When denser core materials are used, up to ¾ of the holes outside the partition were blocked off to provide a higher linear velocity for the air to lift the particles up through the inside of the partition and maintain a smooth circulation of material through the spraying area. The total air flow was adjusted to get a good flow of cores through the partition and keep the bed outside the partition fluidized. Inlet air temperature was adjusted up to a maximum of 75° C. so that the outlet as well as particle temperatures were below 50° C. Typical outlet temperatures during the coating process were 25° C. to 40° C. The solids level of enzyme slurry sprayed in was 15% to 30% of the solution (w/w). Feed rate varied from 5 ml/min. to 20 ml/min. When a more soluble core material was used, a lower initial feed rate was essential to coat a layer of enzymes on the core before the feed rate was increased. Atomization air pressure ranged from 1.0 to 1.5 bar. A typical dry weight gain of the core material after enzyme coating is 10% to 35% depending on the final activity desired. The enzyme coated core was further coated with a polyester, film-forming, water soluble or water dispersible coating agent to seal the enzyme from contact with the atmosphere or persons handling the particle. After application of the enzyme and protective coating, the typical total dry weight gain based on the weight of the core material after the dust free coating is 25% to 55%.

In some of the examples below, the core materials are either salt or non-pareils. Salt is totally soluble and water clear when dissolved and is inexpensive as a core material. Being a solid crystal and not a multicompound structure, it is less subject to breaking up during the coating process and the enzyme slurry can be sprayed at a faster rate. However, the salt particles being cubes make them more difficult to coat because there is a greater tendency for poor binding between the film and the core. Furthermore, enzyme coated salt crystals are more subject to film loss due to attrition from the corners of cubes striking the flat surfaces of others. This problem can be partially alleviated by adding binders or plasticizers to the enzyme slurry. Suitable materials include carboxymethyl cellulose, sodium alginate, collagen, polyethylene glycol and ethoxylated alkylphenols in an amount of from 1 to 10% (w/w) of the total solids in the slurry. In addition, the flat surfaces provide larger areas of contact between particles which can cause agglomeration thereby inhibiting the flow characteristics of the coated salt particles. The non-pareils are spherical, can readily be coated with a continuous film and have less area of contact among particles thereby limiting agglomeration. The final spherical product has better flow characteristics than the cubic salt based enzyme product.

Detergent Composition

The present invention also provides a detergent composition which comprises (a) an enzyme-containing granule described as above; (b) a detergent builder; (c) optionally, a surfactant; and (d) optionally, water.

The amount of enzyme granules for use in this invention is about 0.1% to about 20% by weight of detergent composition, preferably about 5% to 10% by weight of detergent composition.

The amount of a builder used in the present invention is about 0.1% to about 60% by weight of detergent composition, preferably about 5% to about 30% by weight of detergent composition.

The amount of a surfactant used in the present invention is about 0% to about 20% by weight of detergent composition, preferably about 5% to about 10% by weight of detergent composition.

In addition to the enzyme granule, the various other components of the present detergent composition are set forth in greater detail below.

Detergent Active

The present detergent composition may contain one or more surfactants selected from the group consisting of anionic, nonionic, cationic, ampholytic and zwitterionic surfactants or mixtures thereof. It is to be understood that any surfactant may be used alone or in combination with any other surfactant or surfactants.

Anionic Surfactant

Suitable anionic surfactants include the alkali metal water soluble higher alkyl benzene sulfonates, alkyl sulfonates, alkyl sulfates and alkyl polyether sulfates. The preferred anionic surfactants are the alkali metal, ammonium or alkanolamide salts of higher alkyl benzene sulfonates and alkali metal, ammonium or alkanolamide salts of higher alkyl sulfonates. Preferred higher alkyl sulfonate are those in which the alkyl groups contain 8 to 26 carbon atoms, preferably 12 to 22 carbon atoms and more preferably 14 to 18 carbon atoms. The alkyl group in the alkyl benzene sulfonate preferably contains 8 to 16 carbon atoms and more preferably 10 to 15 carbon atoms. A most preferred alkyl benzene sulfonate is the sodium or potassium dodecyl benzene sulfonate, e.g. sodium linear dodecyl benzene sulfonates.

Mixtures of higher alkyl benzene sulfonates and higher alkyl sulfonates as well as mixtures of higher alkyl benzene sulfonates and higher alkyl polyether sulfates can be used.

Nonionic Surfactant

Below described are nonionic surfactant which can be used alone or in combination with other surfactants.

Typically suitable nonionic surfactants are polyalkoxylated lipophiles. A preferred class of nonionic surfactant is the alkoxylated alkanols wherein the number of moles of alkylene oxide (of 2 or 3 carbon atoms) is from 3 to 12.

Other useful nonionic surfactants are the reaction products of a higher linear alcohol and a mixture of ethylene and propylene oxides, containing a mixed chain of ethylene oxide and propylene oxide, terminated by a hydroxyl group. For example, $C_{13}$-$C_{15}$ fatty alcohol condensed with 6 moles ethylene oxide and 3 moles propylene oxide, etc.

Another group of liquid nonionic surfactants are ethoxylated $C_9$-$C_{11}$/$C_{12}$-$C_{15}$ fatty alcohol with ethylene oxide. Preferred are the $C_{12}$-$C_{15}$ primary fatty alcohols with relatively narrow contents of ethylene oxide in the range of from about 7 to 9 moles, and the $C_9$-$C_{11}$ fatty alcohols ethoxylated with about 5-6 moles ethylene oxide.

Cationic Surfactants

Almost any cationic surfactant having at least one long chain alkyl group of about 10 to 24 carbon atoms is suitable in the present invention. Such compounds are described in "Cationic Surfactants", Jungermann, 1970, incorporated herein by reference.

As with the nonionic and anionic surfactants, the cationic surfactants may be employed alone or in combination with any of the other surfactants known in the art in the present detergent composition. Of course, the composition may contain no cationic surfactants at all.

Amphoteric Surfactants

Ampholytic surfactants can be broadly described as derivatives of aliphatic or aliphatic derivatives of heterocyclic secondary and tertiary amines in which the aliphatic group may be straight or branched chain and one of the aliphatic substituents contains from about 8 to 18 carbon atoms and at least one contains an anionic water-solubilizing group, e.g. carboxy, sulfonate, sulfate. Examples of these compounds falling within this definition are sodium 3-(dodecylamino)propionate, sodium 2-(dimethylamino)octadecanoate, sodium N,N-bis(2-hydroxyethyl)-2-sulfato-3-dodecoxypropylamine. Sodium 3-(dodecylamino)propane-1-sulfonate is preferred.

Zwitterionic surfactants can be broadly described as derivatives of secondary and tertiary amines, or derivatives of quaternary ammonium, quaternary phosphonium or tertiary sulfonium compounds. In all of these compounds there is at least one straight or branched aliphatic group, containing from about 3 to 18 carbon atoms and at least one aliphatic substituent containing an anionic water-solubilizing group, e.g., carboxy, sulfonate, sulfate, phosphate, or phosphonate.

Builders

Any conventional alkaline detergency builders can be used in this invention, including inorganic or organic builders.

Examples of suitable inorganic alkaline detergency builders are water-soluble alkalimetal phosphates, polyphosphates, borates, silicates, and carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., sodium and potassium ethylenediaminetetraacetates; (2) water-soluble salts of phytic acid, e.g., sodium and potassium phytates; (3) water-soluble polyphosphonates, e.g., sodium, potassium and lithium salts of ethylene diphosphonic acid, etc.; (4) water-soluble salts of polycarboxylate polymers and copolymers.

BEST MODE FOR CARRYING OUT THE INVENTION

The following examples will more fully illustrate the embodiments of this invention. Therefore, they should not be construed as limitative of the remainder of the disclosure in any way. All parts, percentage and proportions referred to herein and in the appended claims are by weight unless otherwise indicated.

EXAMPLE 1

Six composite polyester resins were synthesized according to the recipes given in Table 1 below:

TABLE 1

Composition Of Composite Polyester Resins

| Ingredients | 1 | 2 | 3 | 4 | 5 | 6 |
|---|---|---|---|---|---|---|
| ethylene glycol | 19.05 | 20.0 | 25.0 | 11.0 | 15.0 | 20.0 |
| neopentyl glycol | 5.04 | 5.0 | | | 12.0 | |
| pentaerythritol | 2.18 | | | | | |
| ethoxylated glycerine | 11.01 | 11.5 | 20.0 | | | |
| monobutyl stannoic acid | 0.08 | 0.1 | | 0.08 | 0.1 | 0.1 |
| scrap PET | 30.47 | | | 30.0 | | |
| scrap PBT | | 29.5 | | | 40.0 | |
| scrap poly CHDT* | | | 30.0 | | | 40.0 |
| isophthalic acid | 25.87 | 30.0 | 24.8 | 23.36 | 32.0 | 35.0 |
| trimellitic anhydride | 6.2 | | | 10.0 | | 3.0 |
| tetrapropyl titanate | 0.1 | 1.0 | 0.2 | 0.1 | 0.1 | 0.1 |
| trimethylolpropane | | 2.5 | | | | |

*CHDT is cyclohexanedimethanol terephthalate.

The general procedure for synthesizing the polyester resins 1-6 of Table 1 is described in U.S. Pat. No. 4,977,191 Examples 1-3 and 5-7. Aqueous solutions and dispersions of the polyesters can also be prepared as shown in the '191 patent the entire contents of which are incorporated by reference.

EXAMPLE 2

Preparation of Enzyme Granule

Aqueous solutions of polyester resins of Table 1 were used to coat a cellulase enzyme for incorporation into a concentrated liquid detergent formulation. An aqueous solution prepared by mixing 50 g of polyester resin and 32.5 g of cellulase 100 L (ex. Cellulase 123™) in 2 liters of water was sprayed dried at the following conditions (as shown in Table 2) using a Yamato Pulvis Mini Spray to give free flowing enzyme granule with a particle size in the range of 1 to 40 μm.

TABLE 2

| Spray Drying Conditions | |
|---|---|
| Air inlet temperature | 100° C. |
| Air outlet temperature | 55° C. |
| Atomizing air pressure | 1.5 kgf/cm$^2$ |
| Solution feeding rate | 2.5 ml/min |
| Spraying nozzle | Model |

EXAMPLE 3

Laboratory Fluid Bed Spray Coating of Savinase

One thousand grams of −30 +60 mesh non-pareils (sugar crystals-sugar solution-starch-dextrin-glaze) was charged to the Uni-Glatt and fluidized. An aqueous enzyme slurry with 19% (w/w)-dry solid having was fed into the dryer for coating at the rate of 12 ml/min. A total of 2000 g of enzyme slurry containing 380 g of enzyme solid was used. The enzyme coated particles were further coated with 136 g of a 50% (w/w) solution containing 60 g of the polyester of Example 1 (formulation 2) in water at a feed rate of 12 ml/min. and an inlet air temperature of 50-54° C. A final total of 1350 g of dust free particles was harvested. A recovery of 100% of mass balance yield and a 97.5% recovery of enzyme activity was obtained. The Uni-Glatt operation conditions were as follows:

Air Regulation Flap Level: Fully Open

Product Pressure Differential: 0.5 Kilo-pascals

Outlet Air Pressure Differential: 200-250 mm Water

Atomization Air Pressure: 1.5 Bar

Inlet Air Temperature Setting: 60/64° C. and 50-54° C.

Outlet Air Temperature Range: 30-40° C.

6 inch Wurster Insert

Clearance from Bottom Plate: ¼ inch

Angle setting: 3 mm

EXAMPLE 4

Enzyme Stability in Concentrated Liquid Detergent

Concentrated liquid detergent containing the enzyme granule of Example 2 were prepared according to the formula shown in the Table 3 as shown below. The amounts are in weight percent.

TABLE 3

Composition Of Enzyme-Containing Concentrated Liquid Detergent

| Ingredient | A | B | C | D |
|---|---|---|---|---|
| Alkyl Benzenesulfonic Acid | 10 | 9 | 12 | 15 |
| Alcohol Ethoxylated $C_{12-15}$ 9EO | 2 | 3 | 5 | 4 |
| Coated Cellulase 123 ™ Granule | 0.2 | 0.2 | 0.3 | 0.2 |
| Ethanolamine | 1 | 1 | 1 | 1 |
| Triethanolamine | 2 | 2 | 2 | 2 |
| Lipolase 100L | 0.2 | 0.2 | 0.1 | 0.2 |
| Savinase | 0.1 | 0.1 | 0.1 | 0.1 |
| Citric Acid | 2 | 2 | 2 | 2 |
| Sodium Borate | 2.5 | 2.5 | 3 | 2.5 |
| Glycerol | 4 | 4 | 4 | 4 |
| PEO | 1 | 1 | 1 | 1 |
| Water | To 100% | To 100% | To 100% | To 100% |

EXAMPLE 5

Release of Enzyme in a Wash Condition

The release of the coated enzyme granule in a wash condition was studied at 25° C. and 40° C. 1 g of sample A of Example 3 was added to 1 liter of water and the enzyme activity (cellulase activity in CU/ml) was measured at different times. The results indicate good enzyme activity as a function of wash time.

It is to be understood that the forms of the invention herewith described are to be taken as preferred examples of the same, and that various changes in the shape, size and arrangement of parts may be resorted to, without departing from the spirit of the invention or scope of the subjoined claims.

We claim:

1. An enzyme-containing granule comprising:

(a) a core granule comprising one or more enzyme particles; and a water-soluble polymer coating therefor which completely encapsulates said enzyme particles, said polymer coating comprising a water-soluble or water-dispersible polyester resin, which comprises a reaction product of 20%-50% by weight of waste terephthalate polymer, 10-40% by weight of at least one glycol and 5-25% by weight of at least one oxyalkylated polyol, 20-50% by weight of isophthalic acid and 3-15% by weight of trimellitic acid or trimellitic anhydride.

2. A granule of claim 1, wherein the water-soluble or water-dispersible polyester resin comprises the reaction product of waste terephthalate of the unit formula

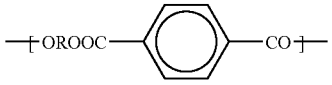

wherein R is the residue of an aliphatic or cycloaliphatic glycol of 2-10 carbons or of an oxygenated glycol of the formula $HO(C_xH_{2x}O)_nC_xH_{2x}OH$, wherein x is an integer from 2-4 and n is 1-10 20-50% weight of isophthalic acid and 3-15% by weight of trimellitic acid or trimellitic anhydride.

3. A granule of claim 1, wherein the waste terephthalate polymer is polyethylene terephthalate, polybutylene terephthalate, poly(cyclohexane dimethanol terephthalate) or a mixture thereof.

4. A granule of claim 1, wherein the glycol is ethylene glycol, diethylene glycol, triethylene glycol, cyclohexanedimethanol, propylene glycol, butylene glycol, neopentyl glycol, 1,5-pentanediol, 1,6-hexanediol or a mixture thereof.

5. A granule of claim 1, wherein the glycol is a mixture of diethylene glycol and neopentyl glycol.

6. A granule of claim 1, wherein the oxyalkylated polyol is glycerol, trimethylolpropane, trimethylolethane, pentaerythritol, erythritol or a monosaccharide, oxyalkylated with 5-30 moles of ethylene oxide, propylene oxide or a mixture thereof, per hydroxyl of the polyol.

7. A granule of claim 1, wherein the water-soluble or water-dispersible polyester resin further comprises 1-10% by weight of a polyol.

8. A granule of claim 1, wherein the water-soluble or water-dispersible polyester resin comprises a reaction product of 20-50% by weight of polyethylene terephthalate, 10-30% by weight of diethylene glycol, 1-10% by weight of pentaerythritol, 5-25% by weight of oxyalkylated glycerol of 5-30 oxyalkyl units per hydroxyl, 20-50% by weight of isophthalic acid and 3-15% by weight of trimellitic acid or trimellitic anhydride.

9. A granule of claim 1, wherein the water-soluble or water-dispersible polyester resin comprises a reaction product of 25-40% by weight of polyethylene terephthalate, 20-30% by weight of diethylene glycol, 1-10% by weight of pentaerythritol, 5-15% by weight of oxyethylated glycerine having 5-30 oxyethylene units per hydroxyl, 20-30% by weight of isophthalic acid and 5-10% by weight of trimellitic acid or trimellitic anhydride.

10. A granule of claim 1, wherein the core enzyme comprises at least one cleaning enzyme selected from the group consisting of amylase, protease, lipase, cellulase, oxidase and mixtures thereof.

11. A granule of claim 10, wherein the enzyme is an amylase.

12. A granule of claim 10, wherein the enzyme is a cellulase or a component thereof.

13. A detergent composition, comprising:

(a) 0.1-20% by weight, based on the composition, of the enzyme-containing granule as claimed in claim 1;

(b) 0.1-60% by weight, based on the composition, of a detergent builder;

(c) 0-20% by weight, based on the composition, of a surfactant selected from the group consisting of anionic, nonionic, cationic, ampholytic and zwitterionic surfactants or mixtures thereof; and (d) optionally, water.

14. A process for producing encapsulated enzyme-containing granule as claimed in claim 1, comprising:

(a) selecting a core enzyme; and (b) contacting a granule of core enzyme with at least one water-soluble or water dispersible polyester resin, which comprises a reaction product of 20%-50% by weight of waste terephthalate polymer, 10-40% by weight of at least one glycol, 5-25% by weight of at least one oxyalkylated polyol; 20-50% by weight of isophthalic acid and 3-15% by weight of trimellitic acid or trimellitic anhydride, and removing any excess water by drying until a continuous film of solid polyester resin is formed around the granule core.

15. A process according to claim 14, in which the granule core is contacted by spraying with an emulsion of the water-soluble or water-dispersible polyester resin as claimed in claim 1.

16. A process according to claim 14, wherein the core enzyme is selected from the group consisting of amylase, protease, lipase, cellulase, oxidase and mixtures thereof.

17. A process according to claim 16, wherein the enzyme is an amylase.

18. A process according to claim 16, wherein the enzyme is a cellulase.

* * * * *